US008695749B2

(12) United States Patent
Zsido

(10) Patent No.: US 8,695,749 B2
(45) Date of Patent: Apr. 15, 2014

(54) BOAT COMMAND CHAIR WITH INSTRUMENT POD

(76) Inventor: Joseph W. Zsido, Benton, IL (US)

( * ) Notice: Subject to any disclaimer, the term of this patent is extended or adjusted under 35 U.S.C. 154(b) by 1183 days.

(21) Appl. No.: 12/568,198

(22) Filed: Sep. 28, 2009

(65) Prior Publication Data

US 2010/0083892 A1 Apr. 8, 2010

Related U.S. Application Data

(60) Provisional application No. 61/195,127, filed on Oct. 3, 2008.

(51) Int. Cl.
*B60K 26/00* (2006.01)

(52) U.S. Cl.
USPC ..... 180/329; 297/10; 297/11; 297/12; 297/411.32; 297/411.33

(58) Field of Classification Search
USPC ..... 297/10, 11, 12, 411.32, 411.33, 411.38; 114/363, 80; 180/329, 333
See application file for complete search history.

(56) References Cited

U.S. PATENT DOCUMENTS

| | | | | |
|---|---|---|---|---|
| 6,039,141 | A * | 3/2000 | Denny | 180/329 |
| 6,267,195 | B1 * | 7/2001 | Takahasi et al. | 180/316 |
| 6,971,194 | B2 * | 12/2005 | McClelland et al. | 37/347 |
| 7,681,686 | B1 * | 3/2010 | Klas et al. | 180/331 |
| 7,721,839 | B2 * | 5/2010 | Kim | 180/315 |
| 7,878,288 | B2 * | 2/2011 | Kostak et al. | 180/331 |
| 2003/0230447 | A1 * | 12/2003 | Wulfert et al. | 180/329 |
| 2012/0103717 | A1 * | 5/2012 | Ruhter et al. | 180/333 |

* cited by examiner

*Primary Examiner* — Toan To
(74) *Attorney, Agent, or Firm* — Wood, Phillips, Katz, Clark & Mortimer

(57) ABSTRACT

A command chair for a water craft includes a seat with at least one arm defining an enclosure with an opening facing away from the seat. An instrument pod has an instrument display side. Guide tracks in the enclosure support the instrument pod for movement between a stored position and a deployed position. In the stored position, the pod is within the enclosed housing with the instrument display side facing away from the enclosure opening and an opposite face of the pod substantially covering the opening. In the deployed position, the pod extends out from the enclosure with the instrument display side substantially horizontal and facing upwardly to display the instruments on top of the pod. A drive, which includes a drive motor inside the pod, is adapted to move the pod along the guide tracks between the stored and deployed positions.

13 Claims, 6 Drawing Sheets

BOAT COMMAND CHAIR WITH INSTRUMENT POD

CROSS-REFERENCE TO RELATED APPLICATION(S)

Priority is claimed in U.S. Provisional Patent Application No. 61/195,127, filed Oct. 3, 2008, entitled "Command Chair Including Retractable Pods with Control Electronics".

STATEMENT REGARDING FEDERALLY SPONSORED RESEARCH OR DEVELOPMENT

Not Applicable.

REFERENCE TO A MICROFICHE APPENDIX

Not Applicable.

TECHNICAL FIELD

The present invention relates to a command chair for a boat, and more particularly to a command chair having a retractable instrument pod associated with the chair.

BACKGROUND OF THE INVENTION AND TECHNICAL PROBLEMS POSED BY THE PRIOR ART

Boats, of course, include a variety of controls and instruments which the boat captain or operator will need to access so that he/she can not only control motion of the boat, but also monitor the boat, including the status of various boat systems. It is also desirable in most situations to allow the boat captain or operator to sit comfortably in a location where he can readily see all around the boat, not only to see water conditions, other boat traffic, etc., but also (particularly in recreational boats, including fishing boats) so that he can himself enjoy the boating experience. Of course, for him to do so also requires that he be able to easily reach and monitor the boat controls and instruments while seated.

While suitable boat command areas may be provided in smaller boats with a chair and/or bench behind the equivalent of an automobile dashboard, in larger boats it is desirable to provide such an area at an elevated location, such as on a sports tower such as shown, for example, in U.S. Design Pat. No. 581,854. This not only allows the boat captain or operator to better survey the area around the boat, but also provides a beautiful location from which the captain can enjoy the experience as well.

Unfortunately, however, while increased operational and enjoyment advantages can be obtained with greater exposure of the command area, so too will the exposure of the area to potentially damaging environmental elements be increased. Thus, even when the controls and instruments in the exposed command area are somewhat protected from splashing, etc., there inevitably will be times (e.g., during bad weather) when extensive amounts of water may get into the command area. Such water can not only corrode materials over time (e.g., particularly in salt water locations) but they can also immediately damage electronic components if they get inside them as well.

The present invention is directed toward overcoming one or more of the problems set forth above.

SUMMARY OF THE INVENTION

In one aspect of the present invention, a command chair for a water craft includes a seat with arms on opposite sides of the seat, with at least one of the arms defining an enclosure with an opening facing away from the seat. An instrument pod has an instrument display side, and guide tracks in the enclosure supporting the instrument pod for movement between a stored position and a deployed position. In the stored position, the pod is within the enclosed housing with the instrument display side facing away from the enclosure opening and an opposite face of the pod substantially covering the opening. In the deployed position, the pod extends out from the enclosure with the instrument display side substantially horizontal and facing upwardly to display the instruments on top of the pod. A drive, which includes a drive motor inside the pod, is adapted to move the pod along the guide tracks between the stored and deployed positions.

In one form of this aspect of the invention, guide wheels are on the corners of a frame on one side of the pod. The frame is at the bottom of the pod when in the stored position. The guide wheels have substantially parallel axes and follow the guide tracks. In a further form, the pod includes a wire opening through the frame, and instrument wires extend from instruments on the inner side of the instrument display side through the instrument pod and out of the instrument pod through the wire opening. In yet another further form, a threaded track follows one of the guide tracks, and a gear is associated with the guide wheel of the followed guide track and drivably engages the threaded track, wherein the drive selectively drives the gear.

In another form of this aspect of the invention, the guide tracks are oriented so that when the instrument pod is initially driven from its stored position toward its deployed position, the pod is moved further into the enclosed housing away from the housing opening.

In a further form of this aspect of the invention, the instrument display side is substantially vertical in the stored position.

In yet another form of this aspect of the invention, the guide tracks include a pair of guide tracks on opposite sides of the enclosure, with the enclosure opening extending between the enclosure opposite sides. The tracks of each of the pair of tracks follow different paths whereby the guide wheels on each side follow different paths.

In still another form of this aspect of the present invention, the path of the track adjacent the enclosure opening of each pair of tracks passes lower than the associated path of the track spaced from the enclosure opening, with the different paths causing initial motion of the pod from the stored position to cause the outermost portion of the pod to retract further into the enclosure and then pivot down before moving out of the enclosure.

In another aspect of the present invention, a command chair for a water craft is provided, including a seat with arms on opposite sides, with at least one of the arms defining an enclosed housing with an opening in a substantially vertical face facing away from the seat. A generally box shaped instrument pod has six sides, with one of the six sides being an instrument display side on which water craft instruments are displayed, and a second of the pod sides is spaced from, opposite to, and generally parallel with, the instrument display side. A drive includes a drive motor inside the pod and is adapted to move the instrument pod between a stored position and a deployed position. In the stored position, the pod is within the enclosed housing with the pod second side substantially covering the housing opening in the one arm. In the deployed position, the pod extends out from the arm enclosed housing with the pod instrument display side substantially horizontal and facing upwardly to display the instruments on top of the pod.

In one form of this aspect of the present invention, first and second guide tracks are on first and second facing sides of the enclosed housing. The first guide track of the first facing side matches the first guide track of the second facing side, and the second guide track of the first facing side matches the second guide track of the second facing side. A frame is on one side of the instrument pod and extends between the instrument display side and the second pod side, and is at the bottom of the pod when in the stored position. Guides are on the corners of the frame movable along the guide tracks. In a further form, the instrument pod includes a wire opening through the one side of the instrument pod, and instrument wires extend from instruments on the inner side of the instrument display side through the instrument pod and out of the instrument pod through the wire opening into the enclosed housing. In another further form, a threaded track follows one of the guide tracks, and a gear is associated with the guide of the followed guide track and drivably engages the threaded track, wherein the drive selectively drives the gear.

In another form of this aspect of the present invention, the guide tracks are oriented so that when the instrument pod is initially driven from its stored position toward its deployed position, the pod is moved further into the enclosed housing away from the housing opening.

DETAILED DESCRIPTION OF THE INVENTION

Figure 1:
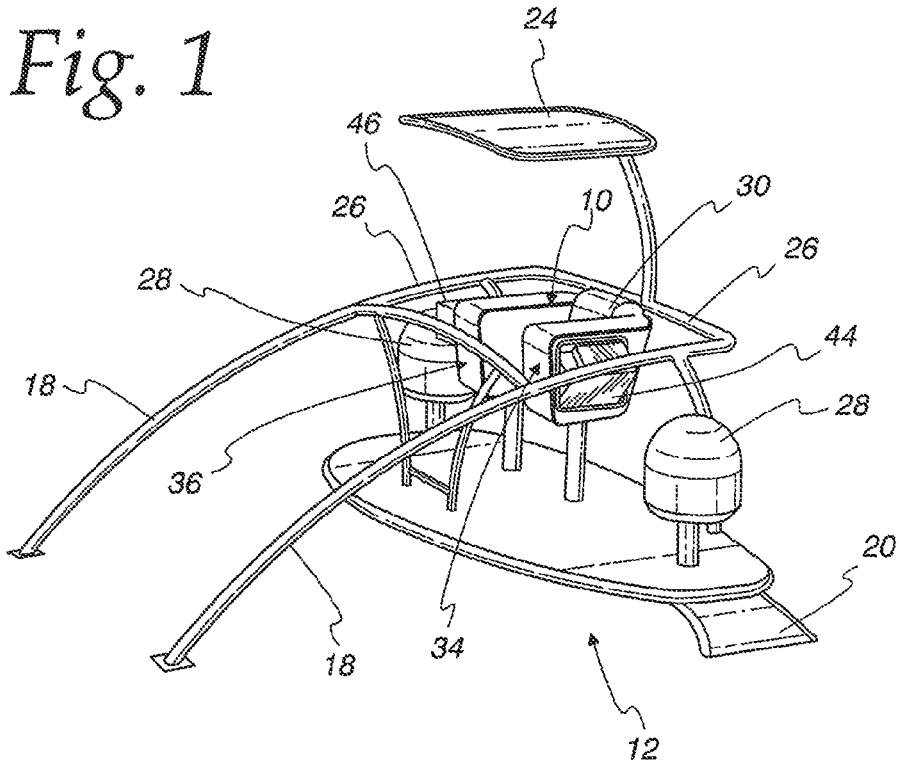
FIG. 1 is a perspective view of a boat sports tower on which a command chair incorporating the present invention may be supported, with instrument pods deployed from the chair.
Figure 2:
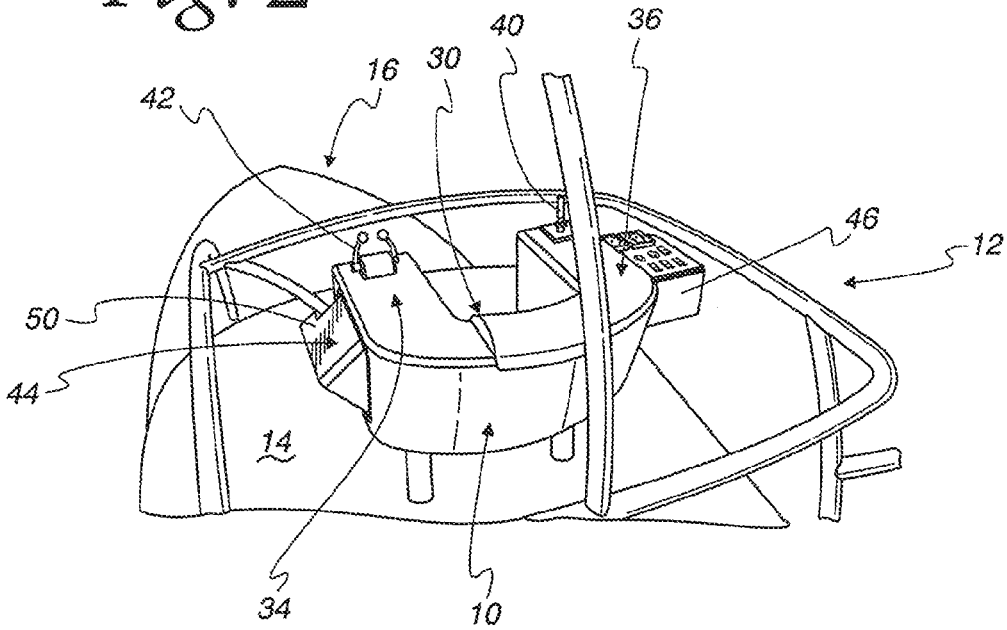
FIG. 2 is a rear perspective view of the command chair and a portion of the sports tower illustrated in FIG. 1.
Figure 3:
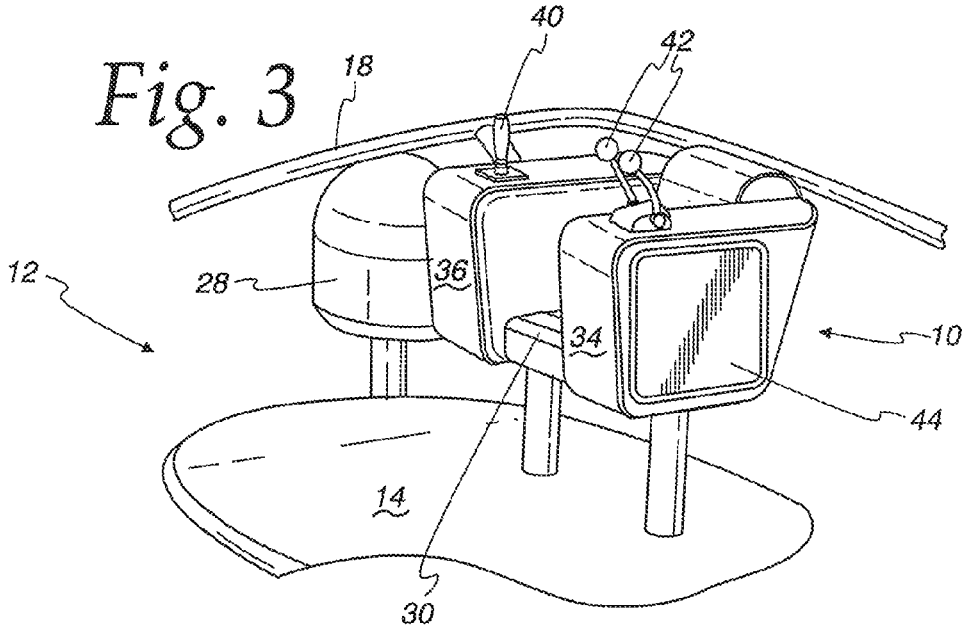
FIG. 3 is a perspective view of the command chair on the sports tower with the instrument pods stored in the chair arms.

A command chair 10 with which the present invention may be advantageously used is illustrated in FIGS. 1-3. The command chair 10 is illustrated on a boat sports tower 12 such as shown, for example, in U.S. Design Pat. No. 581,854, the disclosure of which is hereby incorporated by reference. The tower 12 includes a platform 14 on which the chair 10 is supported, with the tower 12 being supported in a convenient position above the deck of the boat 16, as by supporting rods 18 and legs 20. The platform 14 may advantageously be made of aluminum or fiberglass. It should be appreciated that wiring for the command chair 10 may be extending through the rods 18 and/or legs 20 and/or platform 14, to both protect the wiring and to hide the wiring for aesthetics purposes.

The sports tower 12 may also include a sun shade or umbrella 24 to protect the captain in the chair 10, as well as safety rails 26 and, where desired, communication domes 28 and/or antennas for satellite communication (e.g., for satellite radio, weather, GPS, etc.).

It should be understood that while the illustrated platform 14 may be advantageously used to support a command chair 10 (e.g., by locating the platform 14 at the highest point on the boat 16), the advantages of the present invention could also be obtained with command chairs at still other locations on a boat.

As illustrated in FIGS. 1-3, the command chair 10 includes a seat area 30 with two arms 34, 36 on either side. Suitable electronic controls, such as a control joystick 40 and engine controls 42, may be provided in the top of the arms 34, 36 to allow the seated captain to conveniently handle basic control of the boat 16 while seated in the chair 10.

Instrument pods 44, 46 are retractably mounted in the two arms 34, 36. For example, one pod 44 may include suitable instruments and/or switches in its top side 50 which are covered by the top of the arm 34 when retracted in a stored position as illustrated in FIG. 3. The pod 44 may be tipped out when used, as illustrated in FIGS. 1-2 so that the top side 50 is exposed and uncovered to allow the captain to access it when seated.

The other instrument pod 46 is seen in its operational or deployed position in FIGS. 1-2, and is further illustrated in FIGS. 4-8. As illustrated therein and described below, instrument pod 46 is movable between a stored position substantially enclosed in the chair arm 36 to a deployed or operational position in which is projects out of the arm 36 substantially horizontally. Moreover, the pod 46 is not only enclosed in the arm 36 in the stored position, but it is oriented 90 degrees from the horizontal deployed position in the stored position. As described in more detail hereafter, this configuration of the positions of the pod 46, and the manner in which it is moved between positions, not only allows the pod 46 to present a relatively large horizontal top surface when deployed, but also allows the pod 46 to be stored in a relatively thin space in the arm 36. Still further, the pod 46 and its operation as described herein allows for enhanced protection from inclement conditions (e.g., stormy weather) of the instruments/controls associated with the pod 46, even when the command chair 10 is located in a maximally exposed position.

The chair arm 36 includes a storage recess or enclosure 60 (see FIG. 4) which is substantially open on its outer side (facing away from the seat area 30) between two facing sides 64, 66 within the arm 36.

One pair of guide tracks 70, 71 are located in one of the sides 64. Another pair of guide tracks 72, 73 are in the other side 66, and face and match guide tracks 70, 71, respectively. A threaded or toothed track 76 follows one of the guide tracks 71 on side 64. A second, matching threaded or toothed track 77 may also follow the matching guide track 73 on the other side 66. It should be appreciated that while two threaded tracks 76, 77 may be advantageously provided, only one such track may also be sufficient to support and guide movement of the pod 46 according to the present invention. The threaded tracks 76, 77 may advantageously consist of a curved rack type configuration following one side of the associated guide tracks 71, 73.

A frame 80 on one side of the pod 46 includes guides or guide wheels 84 on its four corners extending into the guide tracks 70-73, which guides 84 will suitably follow the tracks 70-73 (whether by sliding and/or rolling). Advantageously, the guide wheels 84 may be generally cylindrically shaped with an outer diameter slightly less than the width of the associated guide tracks 70-71. Flanges having a larger diameter than the width of the tracks 70-73 and coaxial with the guide wheels 84 may also be provided adjacent the sides 64, 66 to facilitate proper positioning of the guide wheels 84 in the associated tracks 70-73 throughout the range of motion, whereby the frame 80 will follow a path (described further below) while also remaining substantially at right angles to both of the facing sides 64, 66 during that motion.

Coaxial with the guide wheels 84 associated with the guide tracks 71, 73 are drive gears 86. The drive gears 86 may advantageously have a diameter greater than the associated guide wheels 84, and the threaded tracks 76, 77 may advantageously have a greater width than the associated guide tracks 71, 73, so that the threaded tracks 76, 77 are essentially grooves in the sides 64, 66 with a shoulder 88 (see FIG. 8) between the two associated guide and threaded tracks (71 and 76, 73 and 77).

A suitable drive motor 90 carried with the frame 80 (and associated pod 46) rotates a drive gear 92 which in turn drives a driven gear 94 connected to a driven shaft 96 secured for rotation along one side of the frame 80, with the drive gears 86 secured on opposite ends of the shaft 96.

Figure 4:
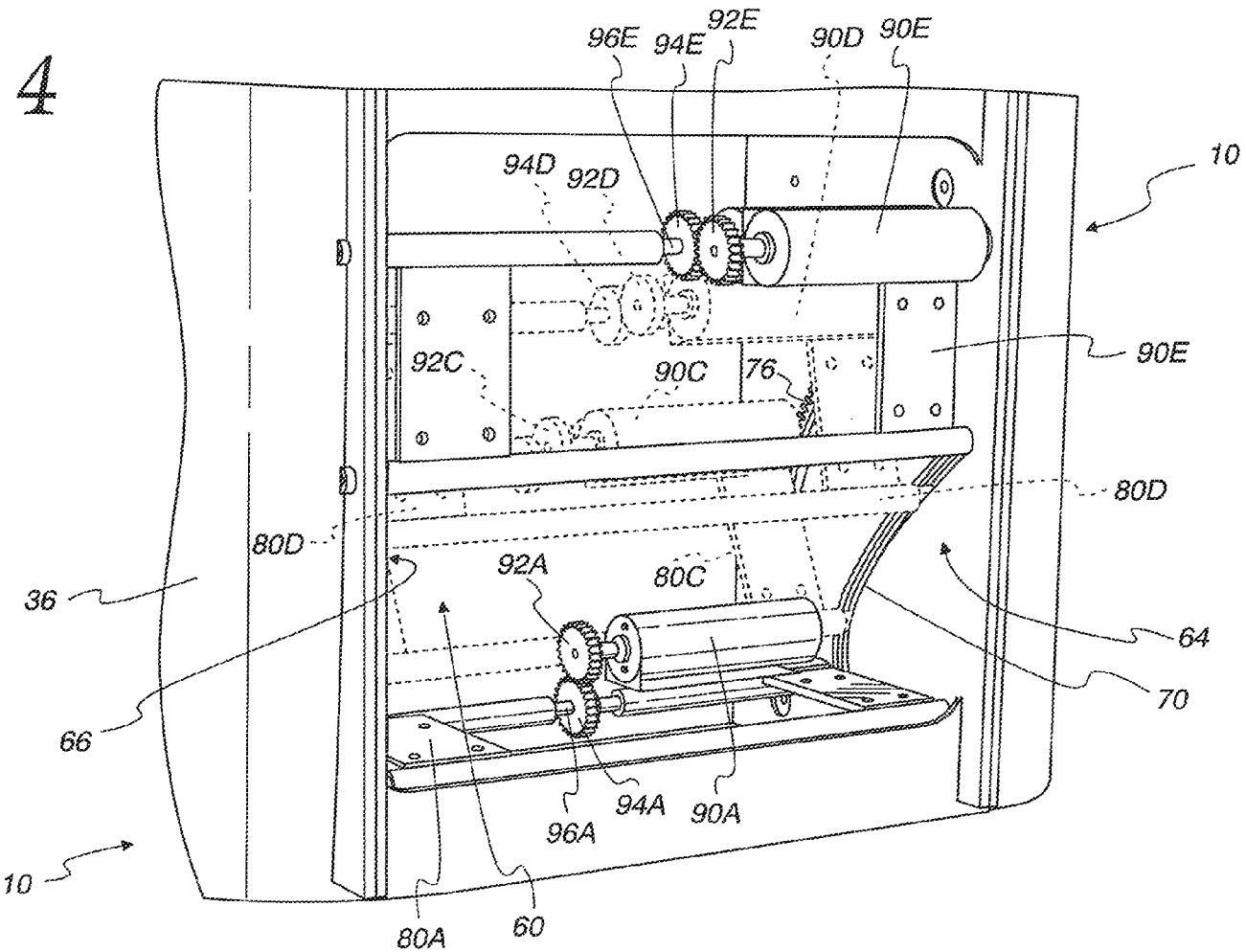
FIG. 4 is a perspective view looking into the open side of an enclosure in the chair arm showing different positions of a pod support frame (and drive structure) with the remainder of the supported pod removed for purposes of illustration.
Figure 6:
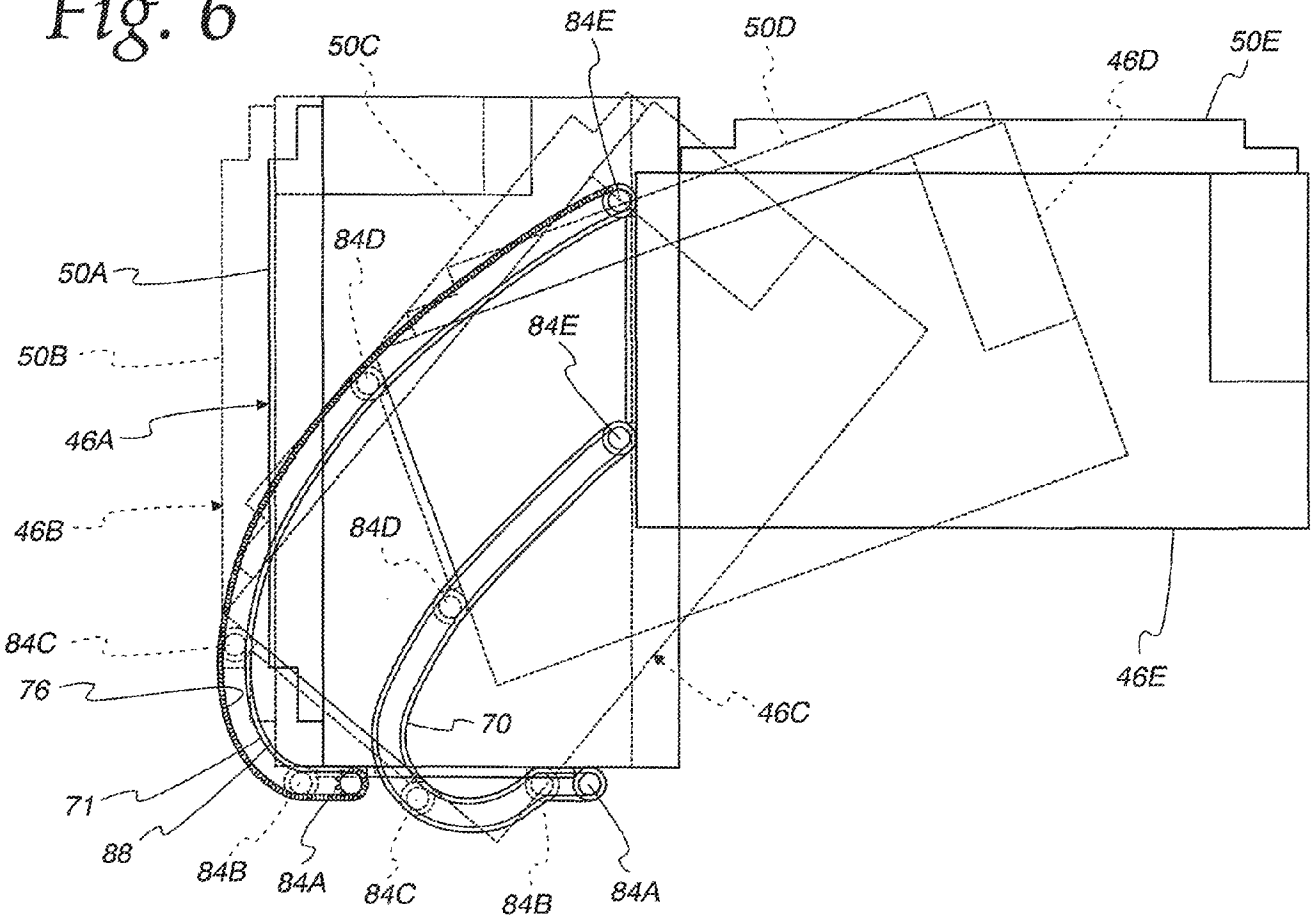
FIG. 6 is a side schematic view illustrating the different positions of the pod illustrated in FIG. 4.

Motion of the pod 46 may thus be controlled as best illustrated in FIGS. 4 and 6, where the frame 80 (FIG. 4) and pod 46 (FIG. 6) are shown in various positions as moved between the stored and deployed positions. It should be appreciated that the relationship of the tracks 70, 72 to the tracks 71, 73 is advantageously such that at each point along the threaded tracks 76, 77 and their associated guide tracks 71, 73, there is a corresponding point along the other tracks 70, 72 which is spaced therefrom by a distance which is substantially equal to the spacing between the two guide wheels 84 on that side of the frame 80. As a result, when the drive gears 86 are rotated to move along their threaded tracks 76, 78 (with the associated guide wheels 84 moving in the associated guide tracks 71, 73, the guide wheels 84 in tracks 70, 72 will follow predetermined paths at their fixed spacing from the other guide wheels 84.

Thus, as shown in FIG. 6, in the stored position the pod 46A is upright with its "top" side 50A in a vertical orientation (and facing toward the back of the enclosure 60, i.e., to the left in FIG. 6) wherein instruments 100 on the top side 50 (see FIG. 5) are most spaced and shielded from the elements (since the open side of the storage recess 60 is on the right in FIG. 6).

The drive motor 90 may be suitably controlled to be activated to move the pod 46. For example, from the stored position illustrated in FIG. 8, the drive motor 90 may be activated to rotate the drive gear 92 counterclockwise (as viewed from the left side in FIG. 8), which in turn rotates the driven gear 94 and the drive gears 86 clockwise, causing the drive gears 86 to crawl along the toothed tracks 76, 77 to move the four corners of the pod 46 supported by the guide wheels 84.

As the pod 46 is moved from the stored position (shown in FIGS. 5, 7 and 8, and indicated by the added "A" designation in the reference numerals in FIGS. 4 and 6), it moves in the upright position for a short distance to the left (i.e., further into the enclosure 60) to intermediate position B (indicated by the added "B" designation in the reference numerals in FIGS. 4 and 6).

From intermediate position B, the drive gears 86 follow an upwardly arcing path with the outermost guide wheels 84 (in tracks 70, 72) following a curved path which initially moves both inward (i.e., to the left in FIG. 6) and down, whereby due to the relative paths of the outermost (relative to the open enclosure 60) of the tracks 70, 72 and the innermost tracks 71, 73, the pod 46C moves to an intermediate position in which the pod 46C has begun tipping out of the enclosure 60.

It should be appreciated that the initial movement to intermediate position B can help to provide clearance space for the upper corner of the pod 46 past the upper lip of the opening of the enclosure 60 when tipping occurs. Importantly, this not only provides clearance in operation but also enables the upper lip of the arm 36 to extend down near to, and even potentially overlapping, the upper corner of the pod 46A in the stored position A to minimize the gaps through which water, etc. may get into the pod 46.

Due to the relative paths of the outermost tracks 70, 72 to the innermost tracks 71, 73, continued motion from intermediate position C to intermediate position D (as driven by drive gears 86 along the threaded tracks 76, 77) results in the pod 46 continuing to tip further while at the same time further extending from the enclosure 60. Such motion continues from intermediate position D to deployed position E, in which the guide wheels 84 and drive gears 86 have reached the end of the tracks 70-73, 76, 77 and the top side 50E is substantially horizontal, extends substantially fully from the enclosure 60, and enables the boat captain to easily access the instruments on the top side 50E while controlling the boat 16 while seated in the command chair 10.

When access to the instruments associated with the pod 46 is not required, the drive gears 86 may be reversed, with the pod 46 then following the same path back into the enclosure 60 to the stored position A.

Figure 5:
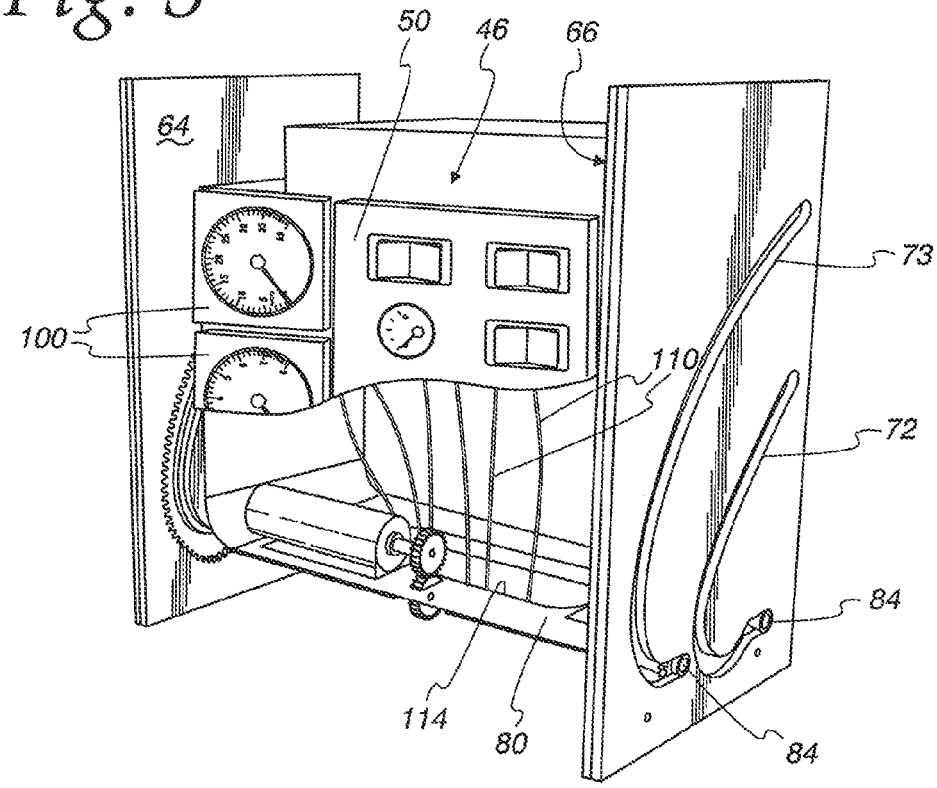
FIG. 5 is a perspective view of the instrument pod as supported between the sides of the chair arm enclosure, with a portion of the pod broken away to illustrate the inside of the pod.
Figure 7:
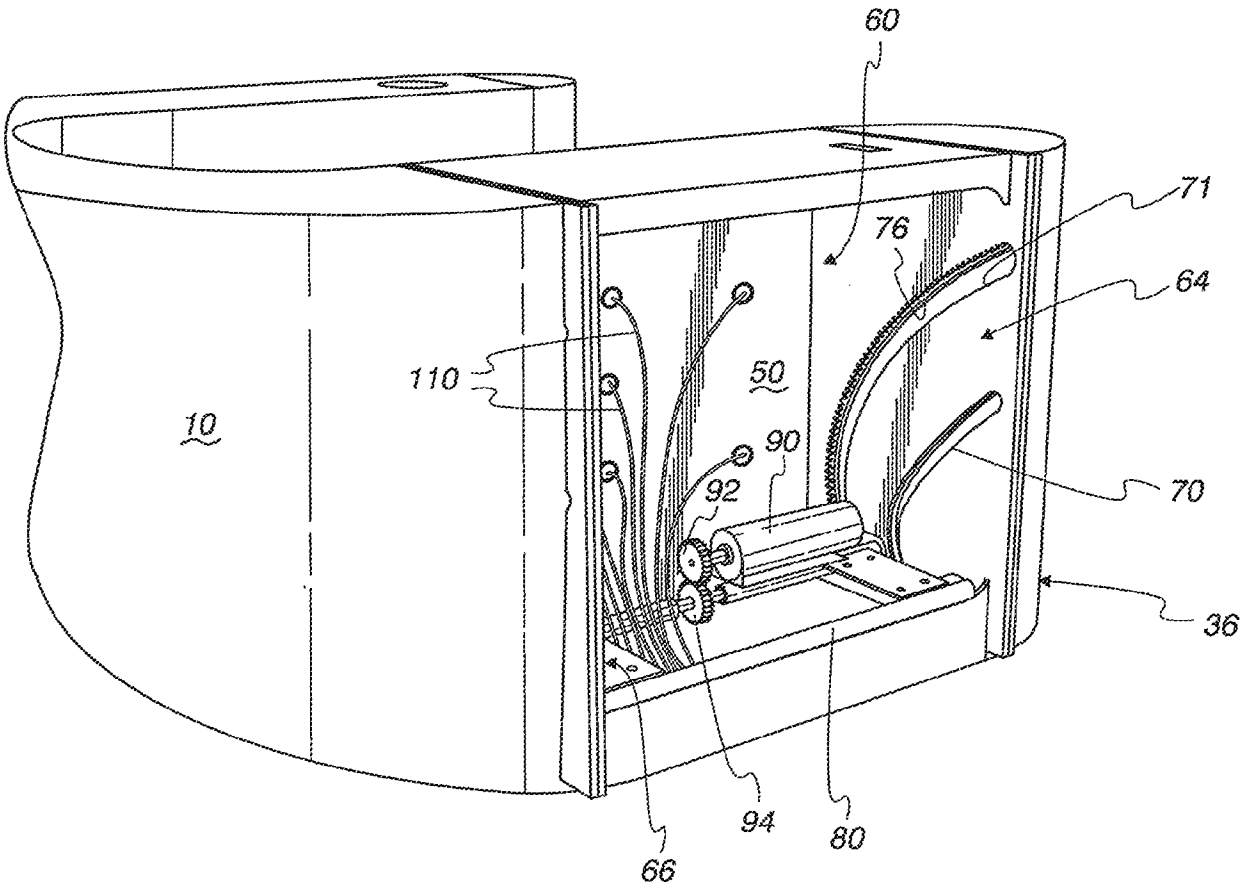
FIG. 7 is a perspective view from the right rear of the command chair of the Figures, showing the pod support frame (and drive structure) in the stored position, with portions of the supported pod removed to illustrate the pod top side and wiring.
Figure 8:
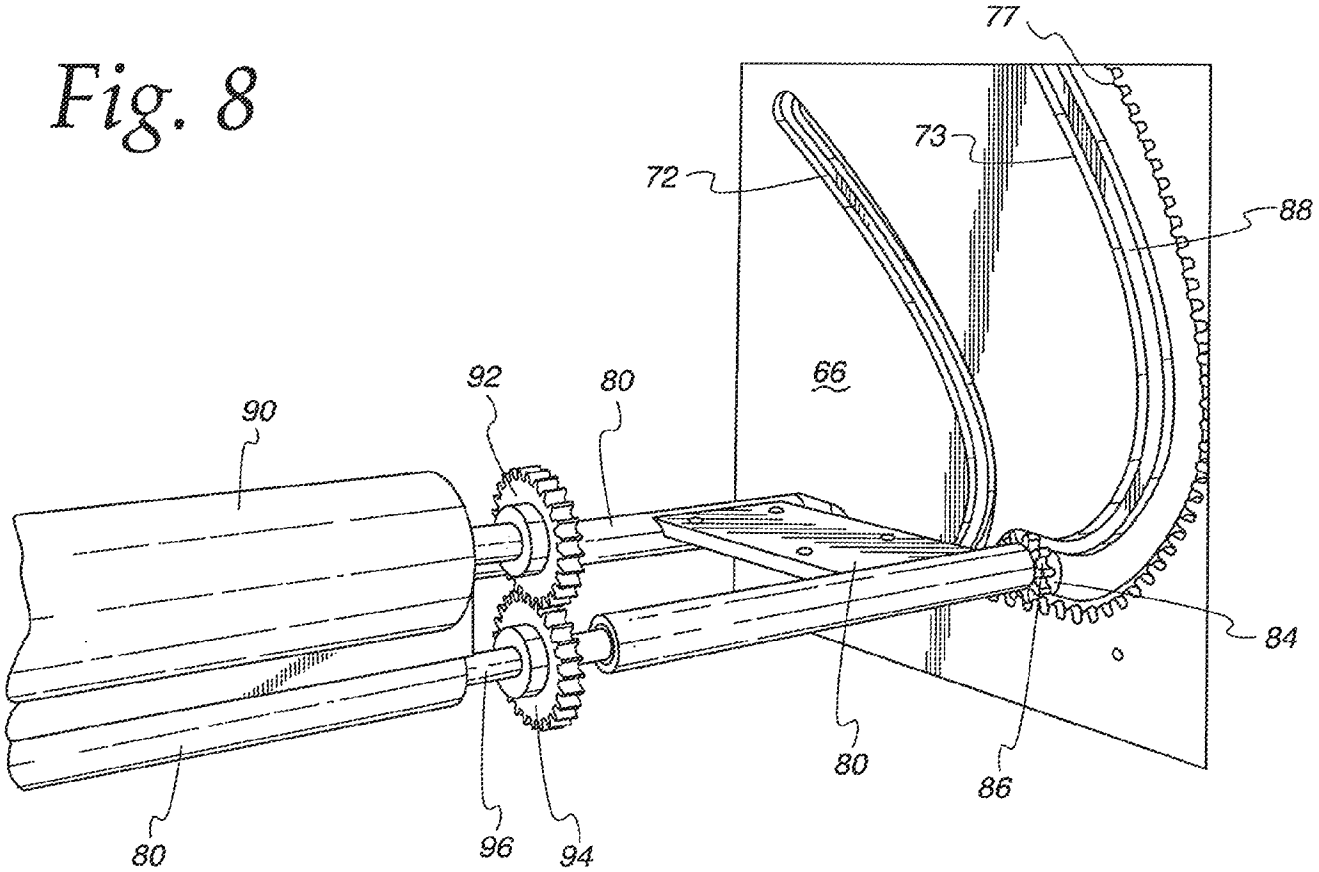
FIG. 8 is a perspective view illustrating the drive structure on the pod support frame supported on one side of the arm enclosure.

For clarity of illustration, only the support frame 80 of the instrument pod 46 (and the drive structure on the frame 80) are illustrated in FIGS. 4 and 8, whereas in FIG. 5 the pod 46 is illustrated with a portion broken away to show the frame 80, and in FIG. 7 only the support frame 80 and the backside (underside in the deployed position) of the top side 50.

From these illustrations, it should be appreciated that any necessary wiring 110 for the instruments 100 may be hidden inside the pod 46, and extend through an opening 114 in the frame 80. Though the wiring 110 is illustrated as being separated within the pod 46, it should be understood that it may also be bundled together for handling and protection as needed. Further it should be appreciated that the side of the opening 114 could be reduced from that illustrated in the drawings to minimize the open space therethrough (e.g., in gaps around the wiring 110) through which environmental elements might otherwise get into the interior of the pod 46. The wiring 110 may pass through the opening 114 out of the pod 46 and into the enclosure 60 in the chair arm 36, from which the wiring 110 may then further extend through parts of the sports tower 12 (e.g., through chair support legs, the platform 14, etc.) so that they can reach where required while also be protected and aesthetically hidden. Suitable length of the wiring 110 may be provided to permit the pod 46 to be moved through its range of motion as previously described without any interference from the wiring 110.

It should be appreciated that since the opening 114 is in the side facing the enclosure 60 when in the deployed position E, the pod 46 is maximally protected against environmental elements, such as rain or splashed water, leaking into its interior through the opening. Moreover, it should also be appreciated that then the pod 46 is in its stored position A (as it most likely would be during extreme environmental conditions such as storms), the frame 80 and its opening 114 are on the bottom of the pod 46, facing downwardly, where not only would the opening 114 will be least able to permit water splashing onto the sports tower 12 to enter the interior of the pod 46, but the orientation is such that in the unlikely event that water would get into the pod 46 it would quickly drain out.

Thus, it should be appreciated that pods 46 according to the present invention may be easily and automatically moved between stored and deployed positions, with the operator required to do nothing more than push a button or throw a switch to activate the drive motor 90. Further, it should now be recognized that the instruments 100 and related wiring 110 associated with the pod 46 may be advantageously protected against damage resulting from environmental elements, particularly water which (obviously) is prevalent in boat environments. Still further, it should be recognized that the motion of the pod 46 as it moves between the stored and deployed positions permits significant surface space to he provided for instruments without requiring thick arms for storage of the instruments. Not only does this allow for more aesthetically pleasing chair arms 36, but it allows the instruments 100 to be positioned close to a boat operator sitting in the seat area 30 (and not a significant arm thickness away from the operator).

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A command chair for a water craft, comprising:

a seat with arms on opposite sides of the seat, at least one of said arms defining an enclosure with an opening facing away from said seat;

an instrument pod having an instrument display side;

guide tracks in said enclosure supporting said instrument pod for movement between:

a stored position within said enclosed housing with said instrument display side facing away from said enclosure opening and an opposite face of said pod substantially covering said opening, and a deployed position extending out from said enclosure with said instrument display side substantially horizontal and facing upwardly to display said instruments on top of said pod; and a drive, including a drive motor inside said pod, adapted to move said pod along said guide tracks between said stored and deployed positions.

2. The command chair of claim 1, further comprising guide wheels on the corners of a frame on one side of said pod with said guide wheels having substantially parallel axes, said guide wheels following said guide tracks, wherein said frame is at the bottom of said pod when in the stored position.

3. The command chair of claim 2, wherein said instrument pod includes a wire opening through said frame, and instrument wires extend from instruments on the inner side of the instrument display side through said instrument pod and out of said instrument pod through said wire opening.

4. The command chair of claim 2, further comprising a threaded track following one of said guide tracks; and a gear associated with the guide wheel of the followed guide track and drivably engaging said threaded track, wherein said drive selectively drives said gear.

5. The command chair of claim 1, wherein said guide tracks are oriented so that when the instrument pod is initially driven from its stored position toward its deployed position, said pod is moved further into the enclosed housing away from the housing opening.

6. The command chair of claim 1, wherein said instrument display side is substantially vertical in said stored position.

7. The command chair of claim 1, wherein said guide tracks comprise a pair of guide tracks on opposite sides of said enclosure, said enclosure opening extending between said enclosure opposite sides, wherein the tracks of each of said pair of tracks follow different paths whereby said guide wheels on each side follow different paths.

8. The command chair of claim 1, wherein the path of the track adjacent the enclosure opening of each pair of tracks passes lower than the associated path of the track spaced from the enclosure opening whereby initial motion of said pod from the stored position causes the outermost portion of the pod to retract further into the enclosure and then pivot down before moving out of the enclosure.

9. A command chair for a water craft, comprising:

a seat with arms on opposite sides of the seat, at least one of said arms defining an enclosed housing with an opening in a substantially vertical face facing away from said seat;

a generally box shaped instrument pod having six sides, one of said six sides being an instrument display side on which water craft instruments are displayed, and a second of said pod sides being spaced from, opposite to, and generally parallel with, said instrument display side;

a drive, including a drive motor inside said pod, adapted to move said instrument pod between:

a stored position within said enclosed housing with said pod second side substantially covering said housing opening in said one arm, and a deployed position extending out from said arm enclosed housing with said pod instrument display side substantially horizontal and facing upwardly to display said instruments on top of said pod.

10. The command chair of claim 9, further comprising:

first and second guide tracks on first and second facing sides of said enclosed housing, the first guide track of the first facing side matching the first guide track of the second facing side, and the second guide track of the first facing side matching the second guide track of the second facing side;

a frame on one side of said instrument pod, said frame extending between said instrument display side and said second pod side and being at the bottom of said pod when in the stored position; and guides on the corners of said frame movable along said guide tracks.

11. The command chair of claim 10, wherein said instrument pod includes a wire opening through said one side of said instrument pod, and instrument wires extend from instruments on the inner side of the instrument display side through said instrument pod and out of said instrument pod through said wire opening into said enclosed housing.

12. The command chair of claim 10, further comprising a threaded track following one of said guide tracks; and a gear associated with the guide of the followed guide track and drivably engaging said threaded track, wherein said drive selectively drives said gear.

13. The command chair of claim 9, wherein said guide tracks are oriented so that when the instrument pod is initially driven from its stored position toward its deployed position, said pod is moved further into the enclosed housing away from the housing opening.

* * * * *